United States Patent [19]

Spanke et al.

[11] Patent Number: 4,932,891

[45] Date of Patent: Jun. 12, 1990

[54] DUAL FLAT-SPRING ELECTRICAL CONTACT

[75] Inventors: Reinhold Spanke, Alfred-Delp-Strasse; Dieter Beer, Staatsbürger, both of Fed. Rep. of Germany

[73] Assignee: C. A. Weidmüller GmbH & Co., Fed. Rep. of Germany

[21] Appl. No.: 396,978

[22] Filed: Aug. 22, 1989

[30] Foreign Application Priority Data

Sep. 7, 1988 [EP] European Pat. Off. ..... 88114544.5

[51] Int. Cl.[5] ..... H01R 4/24

[52] U.S. Cl. ..... 439/395; 439/856

[58] Field of Search ..... 439/389–426, 439/856–858, 861, 862

[56] References Cited

U.S. PATENT DOCUMENTS 3,874,769 4/1975 Simon ..... 439/857
4,408,824 10/1983 Weidler ..... 439/857

FOREIGN PATENT DOCUMENTS 271594 12/1986 European Pat. Off. .
2708753 3/1979 Fed. Rep. of Germany .
3502633 4/1986 Fed. Rep. of Germany .
3626239 2/1988 Fed. Rep. of Germany .

*Primary Examiner*—Joseph H. McGlynn
*Attorney, Agent, or Firm*—Laubscher, Presta & Laubscher

[57] ABSTRACT

A dual flat-spring electrical contact includes a contact receptacle which contains a separation gap and on which spring prongs protrude on one side while the cable connector protrudes on the other side. The contact receptacle is rigidly locked against expansion, as in the area of the separating gap, during insertion of a contact pin between the prongs because on a receptacle wall, in the area of the separating gap, there protrudes a T-shaped cover plate for which there is provided a holding recess which adjoins an adjacent contact receptacle wall.

11 Claims, 1 Drawing Sheet

DUAL FLAT-SPRING ELECTRICAL CONTACT

BACKGROUND OF THE INVENTION

The present invention relates to a dual flat-spring electrical contact having a hollow contact receptacle bent into a generally rectangularly configuration and containing a gap between the bent edges thereof. The receptacle includes a pair of mutually opposed spring prongs extending from one end thereof and a cable connection assembly extending from the other end thereof for receiving an electrical cable. The invention is characterized by a latching assembly which prevents the expansion of the contact receptacle upon insertion of a contact pin between the opposed spring prongs.

BRIEF DESCRIPTION OF THE PRIOR ART

Dual flat-spring electrical contacts are well known in the art. These contacts are typically formed by stamping the contacts out of a relatively thin metal sheet, and then bending the contacts into a desired configuration. Typically, the spring contacts are relatively small and have a wall thickness on the order of few tenths of a millimeter.

In conventional dual flat-spring contacts, one can only obtain a pointed contact arrangement in the case of contacting square pins or rectangular blades because, due to the mechanical stress on the contact prongs, the contact receptacle becomes elastic with respect to the separation gap defined therein. Thus when a pin type contact is arranged between the prongs, the receptacle opens and the gap therein widens owing to the elasticity of the metal from which the contact receptacles are formed. Opening of the separation gap causes a minor oblique positioning of the spring prongs which reduces their effectiveness for establishing electrical contact with a pin inserted therebetween. This problem also exists in known dual flat-spring contacts where the separation gap is located laterally with respect to the contact receptacle, rather in the same plane of the spring prongs as a result of which one obtains multi-prong contact springs.

With these devices, the separation gap is likewise widened and the two contact prongs involved are positioned in an oblique manner, thereby reducing their effectiveness. The aforementioned point-shaped contact arrangement, assuming a constant contact force, leads to an increased contact pressure. This in turn leads to a premature penetration of the contact surfaces during repeated plugging and unplugging of an electrical cable, whereby the contact surfaces are scored down to their base material. In view of the upward spring-like motion of the receptacle, the resultant measurement dimensions must be considered. Furthermore, because of the expansion of the receptacle, the attachment points of the contact force are located eccentrically with respect to the spring prongs resulting in an asymmetrical tension curve with rather high peak tensions.

An attempt has been made to prevent widening of the contact receptacle with the help of a corresponding counteracting device such as an accessory spring as shown, for example, in German application No. 3,502,633 Cl. For this purpose, an additional spring contact receptacle is formed on which there are also small spring lugs to boost the elastic force of the spring prongs. The additional receptacle is arranged about the original spring contact receptacle with the separation gap located in a displaced position.

A primary drawback of this arrangement is the requirement for the accessory part, with the corresponding utilization of additional materials which makes the device to expensive in view of the mass-produced character of such parts. This also involves a rather complicated assembly especially in view of the small size of the spring contacts. Furthermore, in the case of excessive contact forces, the widening of the original spring contact receptacle cannot be avoided with full certainty because the accessory portion in its receptacle area by virtue of its separation gap must also be considered an elastic element and because to that extent the shifting of the two separation gaps alone is not enough in all cases.

In the case of electrical plug-in and connection elements which clearly deviate from this type, it is known that one can obtain a mutually rigid locking of receptacle-like or frame-like parts by making sure that in the area of the separation gap, one or more elements with a unique configuration will protrude from one wall of the receptacle. For these elements, a corresponding recess must be provided in an adjoining wall. This essentially involves the steady clamping cages of various types of clamping devices. These devices are rigid and can absorb insignificant forces without any problem because of increased thickness which provides a secure hold for locking as shown in European patent No. 0271594 Al and in German patent No. 3626239 A1.

To the extent that one uses this type of locking technique in contact elements with a requirement for elastic support, one is dealing with contact sockets such as those disclosed in German published application 2,708,753 wherein the uniquely configured mutually engaging elements do not serve for locking in terms of the reduction of a expansion of the receptacle. Rather, these mutually engaging elements are used only as a terminal stop at the end of a desired and required expansion of the receptacle in terms of the avoidance of an excessive expansion, whereby leeway is provided between the elements involved in the direction of expansion.

In the dual flat-spring electrical contacts of the present invention, it is important that preventing or avoiding widening of the contact receptacle must not in any way threaten the elasticity of the spring prongs.

The present invention was developed in order to overcome the drawbacks of the prior art by providing a dual flat-spring electrical contact of this type which guarantees the prevention of expansion or widening of the contact receptacle while at the same time insuring the necessary elastic support in the area of the spring prongs.

SUMMARY OF THE INVENTION

Accordingly, it is a primary object of the present invention to provide a dual flat-spring electrical contact including a hollow contact receptacle formed from a thin piece of metal bent into a generally rectangular configuration. The receptacle contains a gap between the bent edges thereof. A pair of mutually opposed spring prongs extend from one end of the receptacle and a latching assembly is connected with the receptacle to prevent expansion thereof upon insertion of a contact pin between the springs and prong. The latching assembly includes a latch plate extending from a top wall of the receptacle and a recess arranged in a sidewall of the receptacle adapted to receive the latch plate. When the latch plate is arranged within the recess, the latch plate prevents the receptacle top wall from being displaced from the side wall in the vicinity of the gap when a contact pin is inserted between the prongs, while still affording limited displacement of the spring like prongs during insertion of the contact pin.

In spite of the small size of the receptacle and the small thickness of the walls thereof (the thickness being on the order of a few tenths of a millimeter), the insertion of the latch plate into the corresponding recess leads to a rigid locking of the contact receptacle which prevents any expansion thereof. It has also been found that in spite of this rigidity, the desired spring like characteristics are essentially preserved in the area of the spring prongs. Furthermore, the latch plate is securely retained within the recess during operation of the contact of the receptacle since the latch plate is preferably designed with very little clearance about its perimeter when it is arranged in the recess.

The dual flat-spring contact according to the invention is thus characterized by the absence of the aforementioned disadvantages resulting from expansion or widening of the contact receptacle. Because only the two contact spring prongs are resilient, a linear contacting arrangement is provided having a long life. Lower peak tensions of the receptacles are thus obtained because of the now uniform tension distribution in the two spring prong cross-sections. This results in considerably increased safety against deformation of the plastic insulation surrounding an electrical connector. Furthermore, the relaxation behavior at higher temperatures is considerably less pronounced because of the fact that the peak of the tension is reduced.

BRIEF DESCRIPTION OF THE FIGURES

Other objects and advantages of the present invention will become apparent from a study of the following specification when viewed in the light of the accompanying drawing, in which.

DETAILED DESCRIPTION

Figure 1:
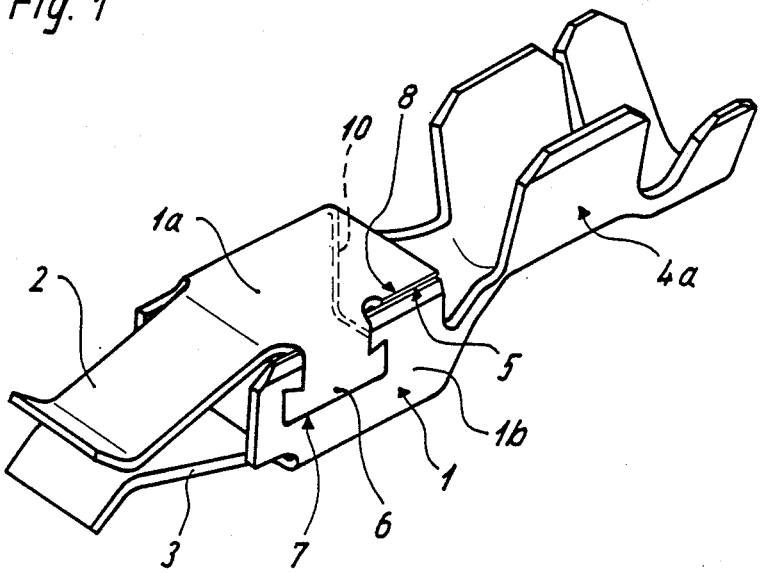
FIG. 1 is a perspective view of a dual flat-spring electrical contact according to a first embodiment of the invention.

There is shown in FIG. 1 a dual flat-spring electrical contact according to the invention. The contact is formed by mass-production techniques in very large numbers by punching a uniquely configured portion of metal from an enlarged piece of sheet metal having a thickness on the order of a few tenths of a millimeter. The punched or stamped metal piece is then folded or bent into a generally rectangular configuration, with the folded edges being spaced by a small gap. Typically, the contact is used for connection with a contact pin on the order of $1\times1$ mm or a flat blade on the order of $0.8\times1.6$ mm to $0.8\times2.4$ mm with a maximum load of the contact assembly amounting to 16 amps. To illustrate this order of magnitude, it should be pointed out that such contacts in terms of their outer dimensions are designed for a screen pattern or a row interval of 5.08 to 5.0 mm.

The dual flat-spring contact essentially comprises a contact receptacle 1 which is formed in each case by rectangular wall sections that are formed by bending according to the design pattern with mutually opposed spring prongs 2, 3 which are joined on two opposite walls of the receptacle. At the end of the contact receptacle 1 which is opposite the spring prongs 2, 3, there is provided a cable connection assembly which, in the version according to FIG. 1, is made in the form of a standard crimping connection 4*a*.

In the dual flat spring contact according to FIG. 1, a separating gap 5 of the contact receptacle 1 is in one of the receptacle corners. To achieve the rigid locking of the receptacle 1 to prevent any widening or expansion during the contacting of a pin or a spring blade by spring prongs 2, 3, there is provided upon one of the contact receptacle walls defining the separating gap 5, an integral protruding clip or latch plate with undercutting geometry. As shown in the example according to FIG. 1, the latch plate extends from the upper wall 1*a* and comprises an essentially T-shaped clip or latch plate. In the side wall 1*b* of the receptacle 1 which adjoins the separating gap 5, there is formed a recess 7 that corresponds to latch plate 6 and receives it. To achieve rigid locking of the contact receptacle 1, care is taken to make sure that the latch 6 will fit without leeway or clearance in the recess 7 at least in the direction of a possible widening or expansion of the receptacle 1.

In order not to have to stress the punching and bending tools that are used with excessively high dimension requirements and narrow tolerances and in order, on the other hand, in view of the dimension deviations that cannot be avoided to that extent, to facilitate the bending or swinging of the latch 6 into the recess 7 without any problem, the dimension of the latch 6 during its cutting or stamping from the sheet metal is so selected that a certain leeway will remain at least on the side of the free terminal edge of the T-shaped latch.

In another version, however, in the course of an additional work operation, the latch 6 is stamped all around without any leeway in recess 7, as a result of which it fits in the recess as a nonelastic, rigid and reliable latching assembly in order to prevent it from getting out of recess 7 upon the application of the widening or expansion forces resulting from insertion of a pin between the spring prongs in view of the very thin wall thicknesses involved.

On the contact receptacle 1, in the area of the gap 5, there is furthermore provided a shoulder 8 which, during the bending of the contact receptacle, is used as a stop and which advantageously limits the bending process.

Figure 2:
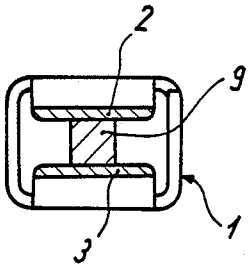
FIG. 2 is a cross-section through the contact area of the dual flat-spring contact of FIG. 1 with a contact pin inserted between spring prongs.

Because only the two spring prongs 2 and 3 move elastically owing to rigid locking of the receptacle, the desired linear contacting arrangement is obtained, for example, upon the insertion of a pin 9 which is to be contacted, as illustrated in FIG. 2.

On one of the walls of the contact receptacle 1, preferably the top wall 1*a* which carries the cover plate 6, there is molded on its terminal edge that is opposite the spring prong 2 a stop shank 10 which is bent downwardly in a rectangular manner. This stop shank 10 prevents the penetration of the corresponding front-end of an electrical cable into the cable connector assembly 4*a* and thus mechanical damage to the plug-in connection upon the insertion into the contact of long pins or blades is avoided. The stop shank on the other hand can also be used as a wire stop during the connection of an electrical wire in the connector assembly 4a.

Figure 3:
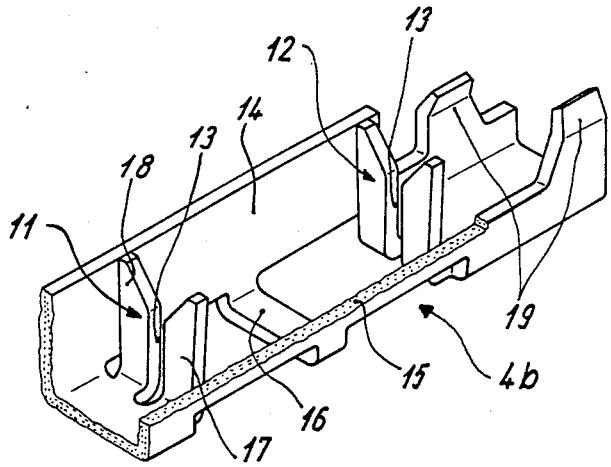
FIG. 3 is a partial perspective view of an alternate embodiment of the contact according to the invention wherein the contact is made in the form of a cutting clamp connection.

In the version illustrated in FIG. 3, the contact receptacle and the spring prongs are shaped identically as in the example according to FIG. 1. On the other hand, the cable connector assembly 4b, which is arranged on the contact receptacle comprises a cutting-clamping connection rather than a crimping connection as in FIG. 1. Two cutting clamps 11, 12 are provided in the embodiment of FIG. 3. The cutting clamp gap 13 is punched in cross-section and is bent up by 90° at one station in the punching tool as a result of which considerable accuracy of the gap dimension during cutting is achieved with small measurement tolerances. The cable connector 4b is essentially channel-shaped and is formed by two side walls 14, 15 which are bent up in U-shape and which are stiffened and stabilized in the bottom area by a connecting bar 16.

Preference is given to a version where the cutting clamp gap 13, as illustrated in FIG. 3, runs over the area of the lower 90° bend Thus, even when small individual conductors are pressed in up to the bottom of the plug-in receptacle, the shank length extends over a 90° arc in the bottom section. Otherwise, in case of a predetermined contact force, the deflection of both cutting shanks 17, 18 could go toward zero or, in case of a predetermined deflection of cutting shanks 17, 18, the contact force could become extremely large. This could lead to a situation where—as a result of the excessive mechanical stress in the area of the cutting gap base—there would be a danger of cracks and rupture or a bundle of slits or a part of the individual wires would be cut through.

It is preferable to vary the inside interval between the side walls 14, 15 which are bent up in U-shape in the punching tool because it can support the elastic behavior of the two cutting shanks 17, 18. By way of the side walls, an additional force can be generated which can be applied upon the cutting shanks in order to increase the contact force in the cutting clamp gap or in order to reduce the bending stress in the cutting shanks while the contact force remains the same.

In another practical modification, there is an insulation crimping zone 19 adjoining the cutting clamps 11, 12. The crimping is done during the insertion of the individual conductors into the cutting clamp cable connector 4b. The insulation crimping keeps traction stresses away from the cutting blades.

While in accordance with the provisions of the patent statute the preferred forms and embodiments have been illustrated and described, it will be apparent to those of ordinary skill in the art that various changes and modifications may be made without deviating from the inventive concepts set forth above.

What is claimed is:

1. A dual flat-spring electrical contact, comprising (a) a hollow contact receptacle formed from a thin piece of metal bent into a generally rectangular configuration, said receptacle containing a gap between the bent edges thereof;

(b) a pair of mutually opposed spring prongs extending from one end of said receptacle; and (c) latch means connected with said receptacle to prevent expansion of said receptacle upon insertion of a contact pin between said spring prongs, said latch means including (1) a latch plate extending from a top wall of said receptacle; and (b 2) said receptacle including a side wall containing a recess adapted to receive said latch plate, whereby when said latch plate is arranged within said recess, said latch plate prevents said receptacle top wall from being displaced from said side wall in the vicinity of said gap when a contact pin is inserted between said prongs.

2. Apparatus as defined in claim 1, wherein said latch plate is configured to fit snugly within said recess.

3. Apparatus as defined in claim 2, wherein said latch plate has a T-shape, and said recess has a configuration corresponding with said T-shaped latch plate.

4. Apparatus as defined in claim 1, wherein said top wall includes a shoulder adjacent said gap.

5. Apparatus as defined in claim 1, wherein said gap is defined in a corner edge of said hollow receptacle.

6. Apparatus as defined in claim 1, wherein at least one wall of said hollow receptacle includes a stop extending from an inner surface thereof, said stop having a rectangular configuration which faces in a direction opposite said spring prongs.

7. Apparatus as defined in claim 1, and further comprising cable-connection means extending from the other end of said receptacle for receiving an electrical cable.

8. Apparatus as defined in claim 7, wherein said cable-connection means comprises at least one cutting clamp connector.

9. Apparatus as defined in claim 8, wherein each cutting clamp connector comprises a pair of spaced cutting shanks extending normal to a bottom wall of said receptacle, said shanks defining a cutting clamp gap arranged in a vertical cross-section of said receptacle.

10. Apparatus as defined in claim 9, wherein said cutting clamp gap extends along an arc of 90°.

11. Apparatus as defined in claim 7, and further comprising crimping means arranged beyond said cable connection means for crimping the insulation of the electrical cable.

* * * * *